US008887409B2

(12) United States Patent
Adams

(10) Patent No.: US 8,887,409 B2
(45) Date of Patent: Nov. 18, 2014

(54) DETACHABLE SHOE PROTECTOR

(76) Inventor: Andrew Adams, Blanding, UT (US)

( * ) Notice: Subject to any disclaimer, the term of this patent is extended or adjusted under 35 U.S.C. 154(b) by 474 days.

(21) Appl. No.: 13/243,991

(22) Filed: Sep. 23, 2011

(65) Prior Publication Data

US 2013/0074363 A1 Mar. 28, 2013

(51) Int. Cl.

| | |
|---|---|
| ***A43B 1/10*** | (2006.01) |
| ***A43B 13/18*** | (2006.01) |
| ***A43B 3/18*** | (2006.01) |
| ***A43B 3/24*** | (2006.01) |
| ***A43B 3/16*** | (2006.01) |
| ***A43B 1/00*** | (2006.01) |
| ***A43B 13/22*** | (2006.01) |

(52) U.S. Cl.

CPC ..... *A43B 13/189* (2013.01); *A43B 3/18* (2013.01); *A43B 3/248* (2013.01); *A43B 3/16* (2013.01); *A43B 1/0027* (2013.01); *A43B 3/163* (2013.01); *A43B 13/223* (2013.01)

USPC ..... 36/7.3; 36/4

(58) Field of Classification Search

CPC ..... A43B 3/16; A43B 3/18; A43B 3/248; A43B 5/18; A43B 1/10; A43B 1/12; A43B 1/14

USPC ..... 36/7.3, 4, 7.5

See application file for complete search history.

(56) References Cited

U.S. PATENT DOCUMENTS

| | | | | | |
|---|---|---|---|---|---|
| RE18,058 | E | * | 5/1931 | Bradley et al. | 36/7.3 |
| 1,811,781 | A | * | 6/1931 | Degge | 36/7.5 |
| 2,281,321 | A | * | 4/1942 | Olson et al. | 36/7.3 |
| 3,724,107 | A | * | 4/1973 | Makinen et al. | 36/7.3 |
| 4,779,360 | A | * | 10/1988 | Bible | 36/7.7 |
| 5,396,717 | A | * | 3/1995 | Bell | 36/7.3 |
| 6,584,704 | B2 | * | 7/2003 | March | 36/7.1 R |
| 2006/0005425 | A1 | * | 1/2006 | Votolato | 36/7.3 |
| 2007/0051014 | A1 | * | 3/2007 | Cromley | 36/7.3 |
| 2007/0113424 | A1 | * | 5/2007 | Bell | 36/7.3 |

* cited by examiner

*Primary Examiner* — Ted Kavanaugh
(74) *Attorney, Agent, or Firm* — Steven Rinehart

(57) ABSTRACT

A detachable, flexible shoe protector is disclosed cover for protecting shoes against inclement weather conditions and for protecting carpet and indoor flooring from dirt carried in on shoes used outdoors. In various embodiments, the shoe protectors may be fabricated from transparent or translucent polymers such that the aesthetic appearance of the underlying shoe is still visible. The rigidity and/or thickness of the shoe protector vary from one embodiment to another depending upon the intended use of that embodiment. Some embodiments of the present invention comprise tread to minimize slipping between the shoe protector and an underlying floor or subgrade. Various embodiments of the shoe protector comprise a forward lip and/or an aft cantilevered tab to facilitate ease of use. The shoe cover has a front portion, a rear portion and a sole portion.

8 Claims, 5 Drawing Sheets

DETACHABLE SHOE PROTECTOR

BACKGROUND OF THE INVENTION

1. Field of the Invention

This invention relates to shoe protection devices, and more particularly relates to disposable shoe guards meant to temporarily cover the soles of shoes.

2. Description of the Related Art

Apparatii which protect footwear from staining or fouling carpet or interior floors are known in the art, as are apparatti for preventing shoes from being stained or scoffed by ground engaging surfaces. Varied types of flimsy polyurethane covers are available which serve these purposes. These apparatii, however, fail to fulfill a need on the part of pedestrians, athletes, parents, office managers, and other to have a protective sole which does not detract from the appearance and functionality of the underlying shoe, which is durable, and which fits snugly against the shoe itself.

Hospital workers, office personnel, open house visitors, and the like, use special shoe covers to keep flooring clean and contaminant free. Construction workers, fisherman, and others use heavy shoe protectors which are black, colorless, or otherwise cumbersome and unattractive.

There exists a need in the industry for detachable, flexible shoe protector for protecting shoes against inclement weather conditions and for protecting carpet and indoor flooring from dirt and rocks carried in on shoes used outdoors, which protector can also be used effectively in a variety of applications, including medical environments, and in strenuous activities. The protector should be non-obtrusive, not detract from the aesthetics of the underlying shoe chosen by the wearer, while also being durable and inexpensive to manufacture.

SUMMARY OF THE INVENTION

From the foregoing discussion, it should be apparent that a need exists for a detachable shoe protector. Beneficially, such a measuring device would overcome many of the difficulties with prior art by providing a more functional apparatus to consumers and professionals, which is durable and easier to use.

The present invention has been developed in response to the present state of the art, and in particular, in response to the problems and needs in the art that have not yet been fully solved by currently available apparatii and methods. Accordingly, the present invention has been developed to provide a detachable shoe protector comprising: a translucent flexible polyurethane guard shaped to contour the sole of a shoe, the cup comprising a sole underlying the shoe, a forward lip, a rearward cantilevered tab, a right lateral side, and a left lateral side; wherein the shoe protector is formed from seamless material; wherein the left lateral side and the right lateral side arise orthogonally from the sole on its outer edge; wherein the forward lip and the rearward tab comprise thicker, more rigid polyurethane than the right lateral side and the left lateral side; wherein the rearward cantilevered tab juts from a proximal end in cantilevered fashion from the protector.

In some embodiments, the detachable shoe protector further comprises a roughly toroidal rim circumscribing an upper edge of the shoe protector.

The detachable shoe protector may further comprise a stretchable elastic band circumscribing the upper edge of the shoe protector within the toroidal rim.

The detachable shoe protector may also have tread disposed on an underside of the elastomeric sole for engaging a ground surface.

The shoe protector may be colored in one or more of white, black, red, blue, green, orange and yellow. The forward lip may rise from a distal end of the protector higher than both the left lateral side and the right lateral side, wherein the forward lip curves inward along its rise for gripping a forward portion of the shoe.

The forward lip, the left lateral side, the right lateral side, and the rearward cantilevered tab may all rise from sole to a height predetermined to correspond to the height of a shoe sole for which the protector is intended to protect.

The forward lip, the left lateral side, the right lateral side, and the rearward cantilevered tab may all further comprise inwardly jutting lips for gripping a top edge of the shoe sole.

A flexible polyurethane detachable shoe guard shaped to contour the sole of a shoe is also disclosed, the guard comprising: a sole, a right lateral side, and a left lateral side; wherein the shoe guard is formed from substantially waterproof, seamless material; and wherein the left lateral side and the right lateral side arise orthogonally from the sole.

The shoe guard may further comprises padding disposed on an underside of the elastomeric sole for engaging a ground surface. The padding may further comprise one of silicone gel, elastomeric foam, and leather. In some embodiments, the translucent shoe guard has tread disposed on an underside of the elastomeric sole for engaging a ground surface. The detachable shoe guard may further comprise a forward lip rising from a distal end of the protector higher than both the left lateral side and the right lateral side, wherein the forward lip curves inward along its rise for gripping a forward portion of the shoe.

A translucent flexible polyurethane detachable shoe guard is disclosed comprising: an elastomeric sole tapered at its distal end for underlying a sole of a shoe; an inverted skirt affixed to the elastomeric sole, the inverted skirt contoured around its perimeter to fit snugly against flanks of a shoe; and tread disposed on an underside of the elastomeric sole for engaging a ground surface.

The shoe guard may further comprise a roughly toroidal rim circumscribing an upper edge of the shoe protector. The shoe guard may further comprise a stretchable elastic band circumscribing the upper edge of the shoe protector within the toroidal rim.

The shoe guard may also comprises padding disposed on an underside of the elastomeric sole for engaging a ground surface. The padding may further comprise one of silicone gel, elastomeric foam, and leather.

The shoe guard may also have tread disposed on an underside of the elastomeric sole for engaging a ground surface.

The shoe guard may be colored in one or more of white, black, red, blue, green, and yellow. The forward lip may rise from a distal end of the protector higher than both the left lateral side and the right lateral side, wherein the forward lip curves inward along its rise for gripping a forward portion of the shoe.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
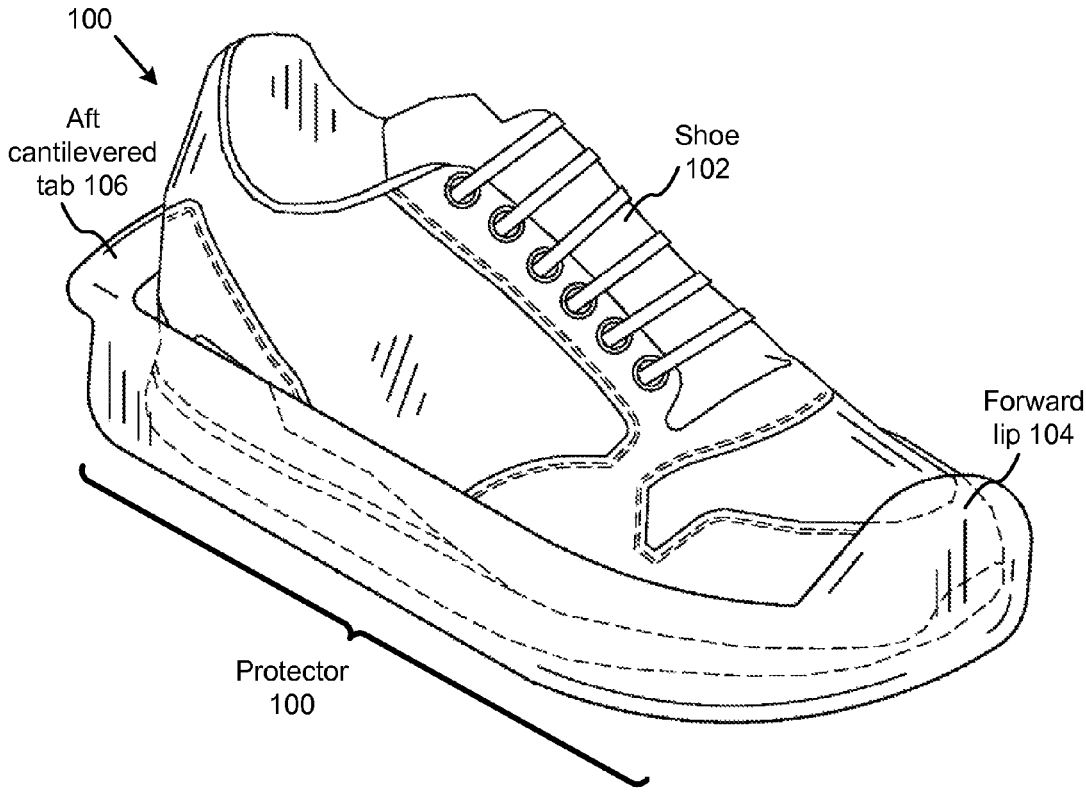
FIG. 1 is a side elevational perspective view of a detachable shoe protector in accordance with the present invention.

FIG. 1 is a side elevational perspective view of a detachable shoe protector 100 in accordance with the present invention. The shoe protector 100 comprises a shoe 102, a forward lip 104 and an aft cantilevered tab 106.

The shoe 102 is well-known to those of skill in the art, and may comprise running shoes, walking shoes, dress shoes, tennis shoes, boots, sandals, and the like.

The shoe protector 100, in the shown embodiment, comprises a polyurethane guard which envelopes the underside of the shoe 102. In some embodiments of the present invention, the protector 100 is fabricated from elastomeric materials while in other embodiments the protector 100 is fabricated from organic materials, such as leather.

In the shown embodiment, the protector 100 comprises a sole underlying the shoe 102 and an inverted skirt which juts orthogonally from the outer edge of the outside edge of the sole.

This inverted skirt comprises four sub-portions, including a left lateral side, a right lateral side, a rearward cantilevered tab 106, and a forward lip 104. The inverted skirt may be affixed using means known to those of skill in the art to the sole. Alternatively, the inverted skirt and the sole may form a seamless continuous piece manufactured using means known to those of skill in the art, including plastic mold injection, 3D printing, machining, and the like.

In the shown embodiment, the rearward (e.g. aft) tab 106 juts from the proximal (e.g. rearward) end of the protector 100. The rearward tab 106 may be thicker and more rigid than the remaining portions of the protector 100. The rearward tab 106 serves to facilitate more convenient use of the protector 100.

The protector 100 is detachable affixed to the shoe 102. In various embodiments, the protector 100 is slipped onto the lower portion of the shoe 102, while is other embodiments, in which the protector 100 is formed from more rigid materials, the protector 100 may be forcibly snapped onto the lower portion of the shoe 102.

The tab 106 may comprise a lip, handle or other means of engaging the fingers of a wearer of the protector 100.

Figure 2:
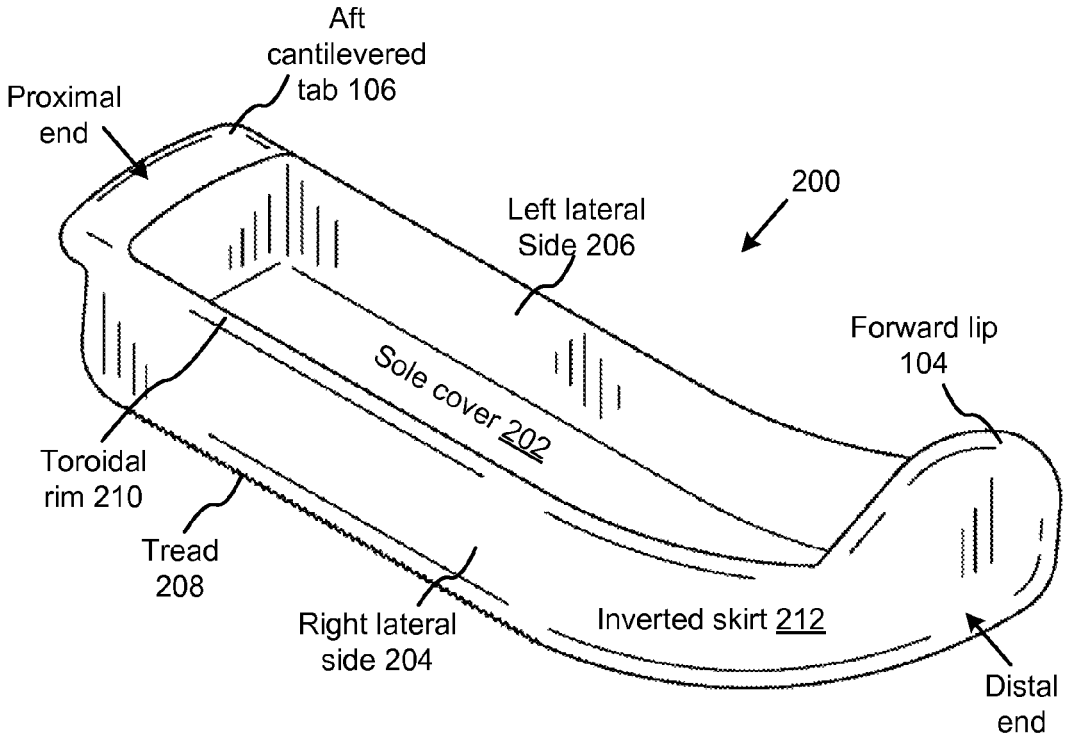
FIG. 2 is a side elevational perspective view of another embodiment of a detachable shoe protector in accordance with the present invention.

FIG. 2 is a side elevational perspective view of another embodiment of a detachable shoe protector 200 in accordance with the present invention. The shoe protector 200 comprises a forward lip 104, and a skirt 210 comprising an aft cantilevered tab 106, a sole cover 202, a right lateral side 204, a left lateral side 206, tread 208, a toroidal rim 210, and an inverted skirt 212.

The sole cover 202 underlies the sole of the shoe 102. The periphery protector 200 comprises a forward lip 104, and a skirt 210 comprising an aft cantilevered of the sole cover 202 substantially conforms to the shape of the sole of the shoe 102. It is from the sole cover 202 that the inverted skirt 212 arises.

The inverted skirt 212 comprises the remaining components of the protector 200. In various embodiments, the forward lip 104 rises higher from the sole cover 202 than the tab 106. The forward lip 104 may curve inward to facilitate more efficient gripping of the shoe 102.

In various embodiments, the toroidal rim 210 circumscribes the exterior of the inverted skirt 212. In other embodiments, the toroidal rim 210 circumscribes the interior of the skirt 212.

In some embodiments, the skirt 212 comprises one or more lips, or inwardly curving edges, meant to grip the top ledge of the sole of the shoe 102. The toroidal rim 210 may also be configured to grip the top edge of the sole of the shoe 102. In those embodiments, the skirt 212 (along with the left lateral side 206, the right lateral side 204, the forward lip 104, and the tab), all rise from the sole cover 202 only as high as is necessary to cover the sole of the shoe 102, and to cover the components of the shoe 102 housing the foot of a wearer.

In various embodiments, the protector 200 is sufficiently flexible/pliable as to be collapsible. In those embodiments, the protector 200 may roll up, fold up, or collapse so as to facilitate packaging and retail distribution of a plurality of protectors 200.

The treat 208 comprises non-planar protrusions engraved into, or jutting from, the underside of the sole cover 202. The tread 208 may comprise conical-shaped protrusions which are staggered in rows or columns in their arrangement on the underside of the sole cover 202. In other embodiments, the treat 208 comprises circular-shaped ridges, or ridges of any other shape.

Figure 3:
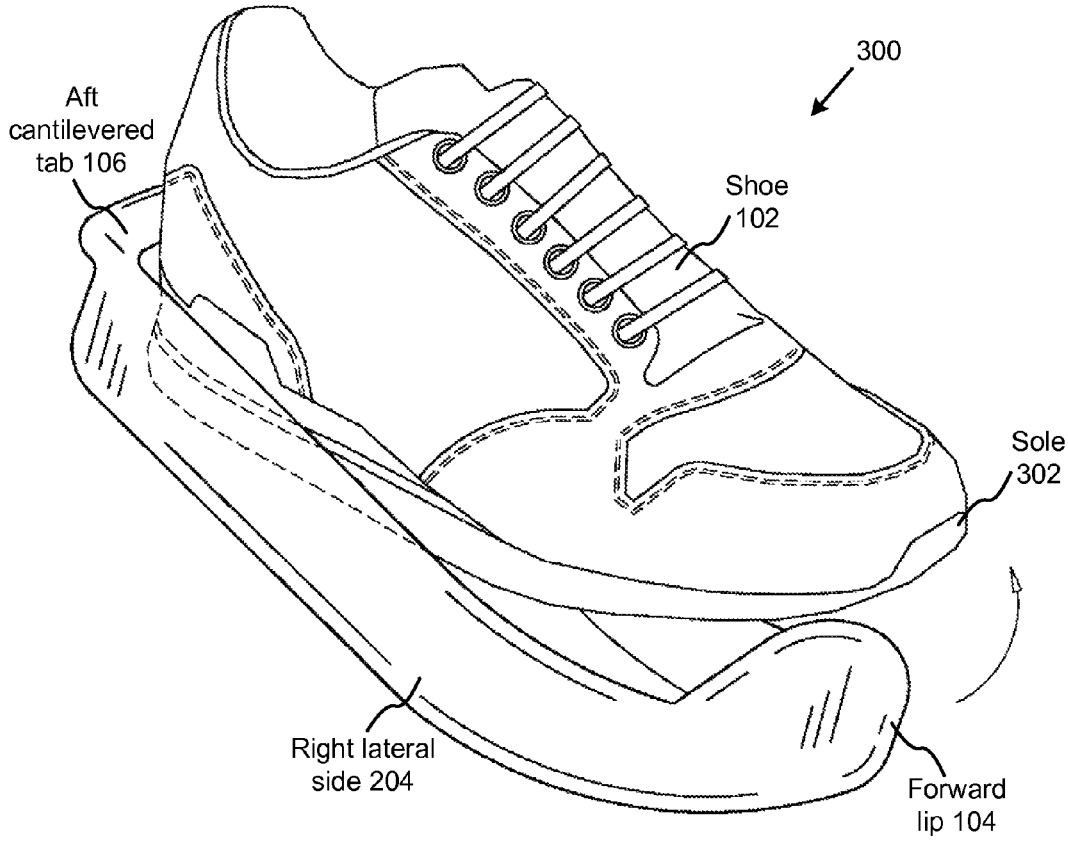
FIG. 3 is a side elevational perspective view of another embodiments of a detachable shoe protector in accordance with the present invention.

FIG. 3 is a side elevational perspective view of another embodiments of a detachable shoe protector 300 in accordance with the present invention. The shoe protector 300 comprises, in the shown embodiment, a shoe 102, a forward lip 104, an after cantilevered tab 106, and a right lateral side 204.

The protector 300 may slide or snap onto the shoe 102 as shown.

In some embodiments of the present invention, the shoe cover 202 is adhered to the underside of the sole of the shoe 102 using means known to those of skill in the art. In the preferred embodiment, however, the protector 300 is not adhered, but is detachable affixed to the shoe 102 using the skirt 212 and/or any of the other components arising from the sole cover 202, including the forward lip 104, the tab 106, the right later side 204, the left lateral side 206, etc.

Various embodiments of the present invention may be manufactured to specific dimensions for compatibility with standard men's or women's shoe sizes. Because of the flexible nature of the materials used in manufacture of the protector 300, various embodiments of the present invention may be compatible with a range of shoe sizes.

Figure 4:
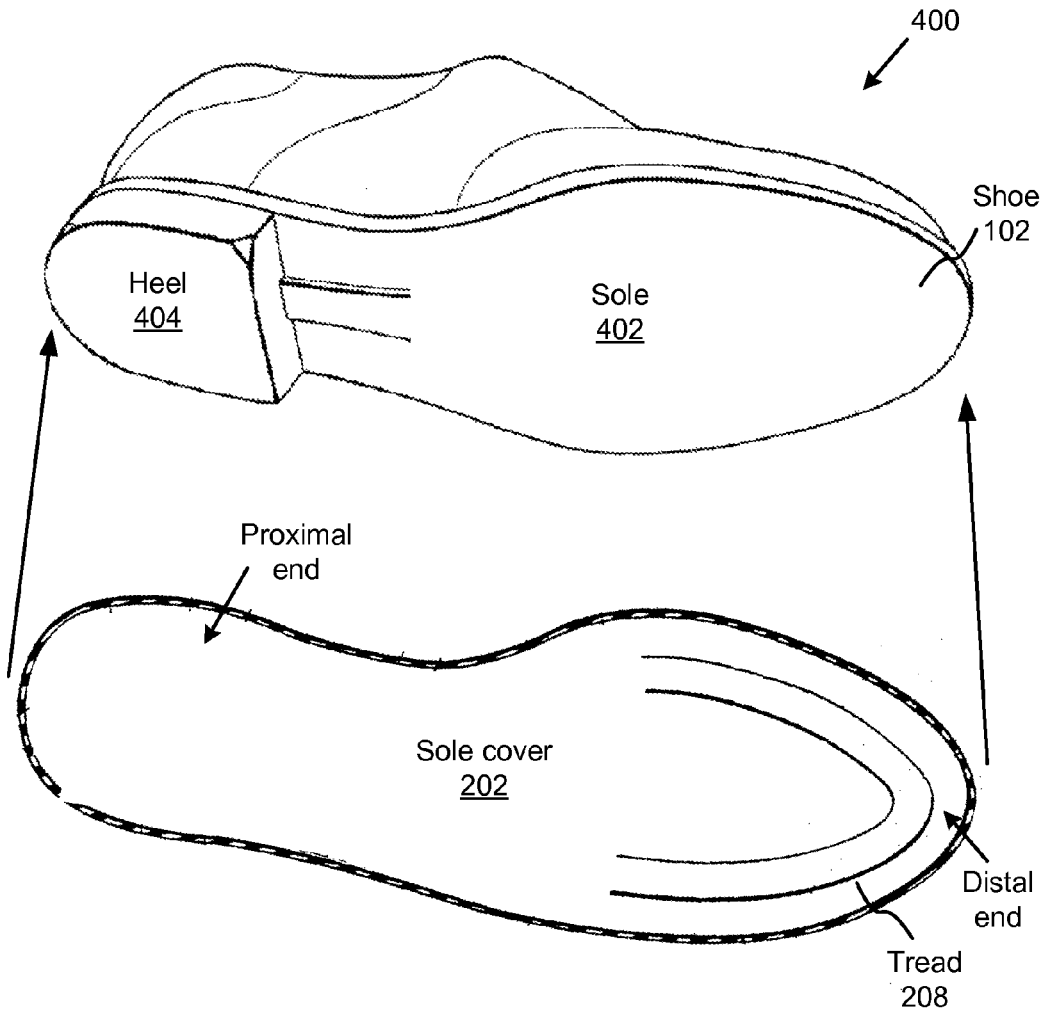
FIG. 4 is a lower perspective view of another embodiments of a shoe and the sole cover of a detachable shoe protector in accordance with the present invention.

FIG. 4 is a lower perspective view of another embodiment of a shoe and a detachable shoe protector 400 in accordance with the present invention. The shoe protector 400 comprises, in the shown embodiment, a shoe 102, a forward lip 104, a tab 106, a tapered sole cover 202, and a right lateral side 204.

FIG. 4 is a lower perspective view of another embodiments of a shoe and the sole cover of a detachable shoe protector 400 in accordance with the present invention. The shoe protector 400, in the shown embodiment, comprises a sole cover 202 and tread 208 substantially described above in relation to FIGS. 1-3. The shoe 102 comprises a sole 402, which sole 402 comprises a heel 404. The sole 402 and the heel 404 are known to those of skill in the art.

The sole cover 202 may be contoured to trace the outside edges of the sole 402 and heel 404. In various embodiments, the sole cover 202 is tapered toward its distal end. It is from its distal end that the forward lip 104 arises.

Despite the fact that the heel 404 may jut beneath the sole 402, the sole cover 202 is substantially planar.

Figure 5:
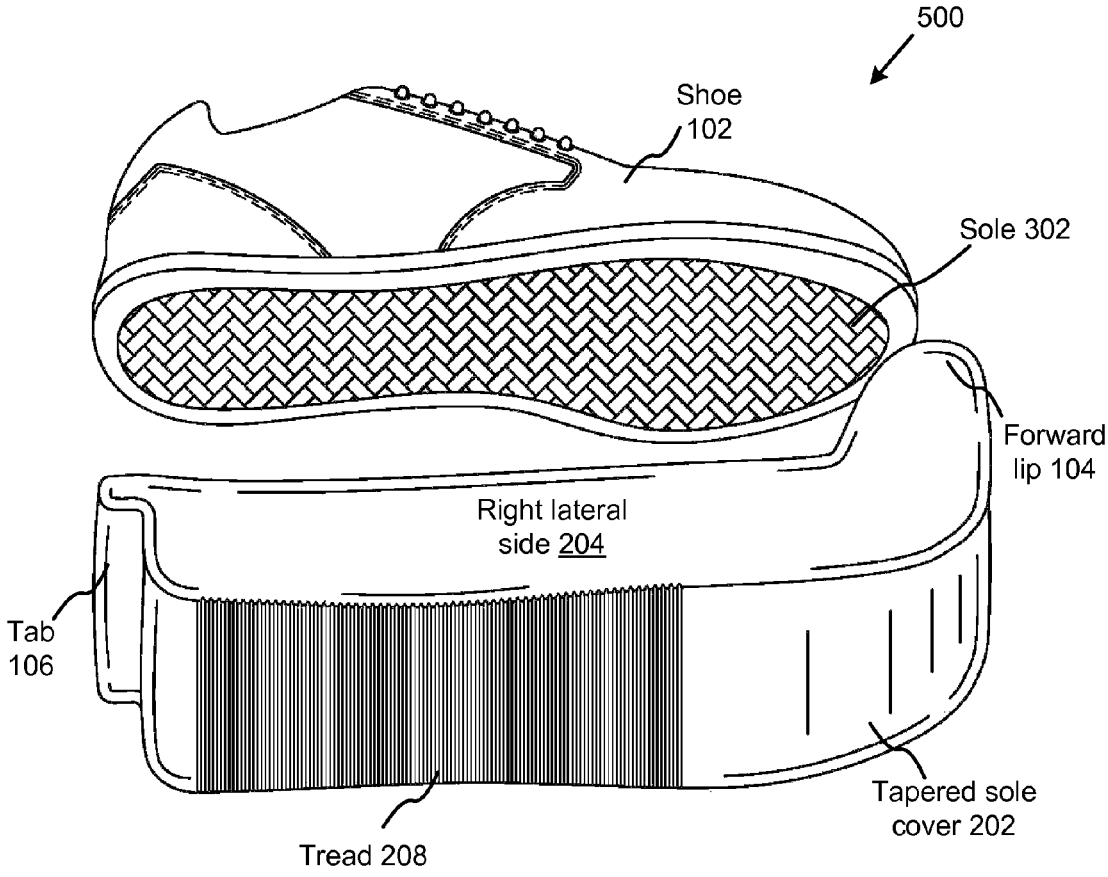
FIG. 5 is a lower perspective view of another embodiments of a shoe and a detachable shoe protector in accordance with the present invention.

FIG. 5 shows an alternative embodiment of the shoe protector. In this embodiment, the shoe protector 500 comprises a more boxy variation which is snapably detachable to the shoe 102.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A detachable shoe protector comprising:

a translucent flexible polyurethane guard shaped to contour the sole of a shoe, the guard comprising a sole underlying the shoe, a forward lip, a rearward cantilevered tab at a proximal end of the shoe protector, a right lateral side, and a left lateral side;

wherein the rearward tab is more rigid and thicker than other portions of the shoe protector;

wherein the forward lip sits higher on a shoe than does the rearward cantilevered tab;

wherein the shoe protector is formed from substantially waterproof, seamless material;

wherein the left lateral side and the right lateral side arise orthogonally from the sole on its outer edge;

wherein the forward lip and the rearward tab comprise thicker, more rigid polyurethane than the right lateral side and the left lateral side;

wherein the rearward cantilevered tab juts from a proximal end in cantilevered fashion from the protector.

2. The detachable shoe protector of claim 1, further comprising a roughly toroidal rim circumscribing an upper edge of the shoe protector, which toroidal rim curves inward.

3. The detachable shoe protector of claim 1, further comprising a stretchable elastic band circumscribing the upper edge of the shoe protector within the toroidal rim.

4. The detachable shoe protector of claim 1, having tread disposed on an underside of the elastomeric sole for engaging a ground surface.

5. The detachable shoe protector of claim 1, wherein the shoe protector is colored in one or more of white, black, red, blue, green, orange and yellow.

6. The detachable shoe protector of claim 1, wherein the forward lip rises from a distal end of the protector higher than both the left lateral side and the right lateral side, wherein the forward lip curves inward along its rise for gripping a forward portion of the shoe.

7. The detachable shoe protector of claim 1, wherein the forward lip, the left lateral side, the right lateral side, and the rearward cantilevered tab all rise from sole to a height predetermined to correspond to the height of a shoe sole for which the protector is intended to protect.

8. The detachable shoe protector of claim 7, wherein the forward lip, the left lateral side, the right lateral side, and the rearward cantilevered tab all further comprise inwardly jutting lips for gripping a top edge of the shoe sole.

* * * * *